United States Patent [19]

Hobson et al.

[11] Patent Number: 5,062,586

[45] Date of Patent: Nov. 5, 1991

[54] MISSILE TRACKING, GUIDANCE AND CONTROL APPARATUS

[75] Inventors: Gregory L. Hobson, St. Peters; Kent Luetkemeyer, Maryland Heights; John R. Wootton, St. Louis, all of Mo.

[73] Assignee: Electronics & Space Corporation, St. Louis, Mo.

[21] Appl. No.: 524,495

[22] Filed: May 17, 1990

[51] Int. Cl.[5] ..... F41G 7/26

[52] U.S. Cl. ..... 244/3.12; 244/3.16

[58] Field of Search ..... 244/3.11, 3.12, 3.13, 244/3.16, 3.17

[56] References Cited

U.S. PATENT DOCUMENTS

| | | | |
|---|---|---|---|
| 4,397,429 | 8/1983 | Fouilloy | 244/3.11 |
| 4,406,429 | 9/1983 | Allen | 244/3.11 |
| 4,666,103 | 5/1987 | Allen | 244/3.11 |
| 4,860,968 | 8/1989 | Pinson | 244/3.12 |
| 4,907,763 | 3/1990 | Pinson | 244/3.12 |
| 4,967,979 | 11/1990 | Balstad | 244/3.11 |
| 4,988,058 | 1/1991 | Dirscherl et al. | 244/3.16 |

*Primary Examiner*—John B. Sotomayor

*Attorney, Agent, or Firm*—Polster, Polster & Lucchesi

[57] ABSTRACT

Apparatus (10) for acquiring and tracking a missile (M), and guiding it to a target (T). Beacons (18, 19) are carried on the missile to provide an indication of its location in a field of view. One beacon (18) is a xenon beacon which emits energy in a short wave-length portion of the light spectrum. The other beacon (19) is a thermal source which emits infrared radiation in a longer wave-length portion of the spectrum. A sight unit (20) includes both a xenon beacon detector and a forward looking infrared receiver (FLIR). The FLIR provides two independent channels (A, B) of video. An electrical signal developed within the sight unit is separately processed on both of the channels. One channel is used to develop a video display for an operator for target acquisition and tracking. The other channel is used for missile tracking and clutter and countermeasure (CM) rejection. A tracking unit (40) processes the signal to determine missile location relative to the target; and, if corrections to the missile freight path are necessary, a missile control unit (56) transmits them to the missile over wires (W). If two or more objects (M, D1, D2) are located in the field of view, a module (88) of the tracking unit undertakes a "segmentation" process to differentiate and characterize the objects to determine which object is the missile and which is not.

29 Claims, 4 Drawing Sheets

MISSILE TRACKING, GUIDANCE AND CONTROL APPARATUS

BACKGROUND OF THE INVENTION

This invention relates to guidance and control systems and, more particularly, to a method and apparatus for launching, guiding and controlling an object such as a missile toward a target.

There has been a great deal of development with respect to tube-launched, optically-tracked, wire-guided missiles commonly referred to as TOW missiles. On the battlefield, a gunner launches a TOW missile at a target which is, for example, a tank. The missile carries beacons which allow the missile to be located as it moves toward the target. One of these beacons is a long wave length beacon and the other is a short wave length beacon. A gunner typically has a sight, the cross-hairs of which he keeps trained on the target to establish a "line-of-sight" therewith. A tracking unit is responsive to the beacons, locations in the field of view (FOV) and to the gunner's aiming point to determine the location of the missile relative to the target. A control system then transmits guidance signals to the missile, via wires running to it, to guide the missile to the target. While initially developed for combat infantrymen to use on the battlefield, the launcher, tracking system and control system can also now be airborne and carried, for example, on a helicopter; or, carried on a ground vehicle. These latter applications allow a greater degree of flexibility, mobility, and survivability for a TOW missile and its crew.

There are a number of problems with respect to tracking and guidance of the missile. One such problem relates to processing the signal developed for the location of the missile in the field of view. When first launched, the missile has an exhaust plume which is sensed as an intense "bow-tie" shaped image superimposed over the image of the long wave length beacon. The tracking signal developed by the tracking unit also registers this intensity level. As the missile moves downrange to the target, the missile's fuel is used up and the plume accordingly disappears. The missile signature is derived from the beacon which travels downrange from the tracker. This results in a diminution of intensity level of the tracking signal. As the missile moves to the target and the energy received from the beacon decreases, the tracking system amplifies the signal before processing it. In some previous TOW missile systems, for example, that shown in U.S. Pat. No. 4,406,429, the signal used for target acquisition and target tracking is also used for missile tracking. However, the requirements of the target tracking system and those of the missile tracking system are not the same and the gain by which the signal is amplified, and the level of the background, do not necessarily have to be the same for both operations. This may therefore require some type of compromise between the target tracking and missile tracking systems. This could effect overall operating efficiency of the system.

A second problem concerns the presence of "blobs" or clutter in the field of view. Blobs appear as points or blooms of light in the display and may be created by countermeasures (CM) taken to present the missile tracker with false targets or to jam the tracking and guidance system. Normal target signature and background clutter may also be sensed on the missile tracking video channel. It is important to be able to quickly and accurately distinguish the missile from the blobs so the missile is not directed away from the target.

A number of schemes have been employed in an attempt to distinguish one object in the field of view from another; and in particular, to track a missile in a CM environment. Among these are edge trackers, centroid trackers, and correlation trackers. In edge tracking, a tracking signal is processed to determine the boundary or edge of the object being tracked. The center or centroid of the object is then determined. In centroid tracking, a tracking signal is processed to determine its center or centroid. In correlation tracking, a reference image of the missile is established. During the course of the missile's flight, a series of scans is made of the field of view which includes the missile. For each scan, the reference image is superimposed over the location in the field of view where the missile is expected to appear. The reference image is then shifted with respect to the field of view until the best mathematical fit or correlation between the reference image and what appears in the field of view is achieved. The resultant location is then considered the location of the missile for that scan.

It will be understood that for each of the above schemes mathematical algorithms are employed to process the data represented by the tracking signal. The algorithms, for example, take into account the diminution of the beacon signal as the missile moves downrange. Also, a defined space or "window" is established within the field of view where the missile is expected to appear and the signal processing is confined to that portion of the signal which represents the area within the window.

One problem with these types of trackers is their inability to distinguish between objects when more than one object appears in the window. Rather, when two or more objects are present, the data for the non-missile objects is "integrated" with that of the missile and the result is a composite that may not represent the true location of the missile. To overcome this difficulty, these systems use a shuttered beacon (so radiation from the beacon can be blocked when the shutter is closed), or an intermittent (blinking) beacon. See, for example, U.S. Pat. Nos. 4,666,103 to Allen, 4,644,397 to Roy et al, and 4,424,943 to Zwirn et al. Each of these patents describes some type of shuttered beacon or blinking beacon system. The premise upon which these systems work is if an object (the missile) appearing at one known time in the field of view can be eliminated from the field of view at another known time, the objects remaining in the field of view at this second known time must be decoys, other missiles, clutter, etc. These objects can then be tagged as such within the tracking system electronics so as to not thereafter interfere with guidance of the missile to its target. While such systems work, difficulties can arise. For example, the shutter system can malfunction. If the shutter system does not block out the beacon when commanded to do so, the point source of light representing the missile will not disappear making it difficult, or impossible, to distinguish the missile from the blobs. Or, if the shutter closes properly, but fails to open, missile tracking is lost. Similar problems occur if a blinking beacon fails in either its "on" or "off" state. The shutter may also be ineffective if the image of the missile and the blob merge. It would be preferable to be able to readily distinguish the missile from the other blobs both without use of a shutter and with a constantly radiating beacon.

SUMMARY OF THE OBJECTS

Among the several objects of the present invention may be noted the provision of a method and apparatus for acquiring, tracking and guiding an object such as a TOW missile to a target; the provision of such apparatus to utilize a beacon such as a thermal beacon on the missile to provide an infrared indication of its position in a field of view; the provision of such method and apparatus to develop electrical signals representing the object and utilize these signals in one video channel to detect and track the target, and in a separate video channel to determine the location of the missile in the field of view relative to the target; the provision of such method and apparatus to command the missile to correct its course in response to its sensed position relative to the target; the provision of such method and apparatus for utilizing separate data channels for the signals and for providing different and varying levels of gain in each channel; the provision of such method and apparatus for continuously scanning the field of view containing the missile and the target; the provision of such method and apparatus for predicting, based upon prior tracking information, the location of the missile in the next scan, and for generating a window or "track gate" for the next scan in the center of which the missile should appear; the provision of such method and apparatus for recognizing other images or "blobs" which appear in the field of view during movement of the missile to the target, the blobs, for example, representing countermeasures taken to have the missile avoid the target; the provision of such method and apparatus for processing those images which appear in the track gate along with the image of the missile; the provision of such method and apparatus for "segmenting" the processed images to differentiate the other images from that representing the missile; the provision of such method and apparatus for performing such differentiation based upon a number of factors including size, shape, and intensity of each image, where it is centered within the window and whether or not it is touching the sides of window; the provision of such segmentation method and apparatus to be useful with other types of signal sources to perform segmentation and produce an output signal usable by other electronics to accomplish a particular function; the provision of such apparatus to be carried on an airborne vehicle such as a helicopter, or on a ground vehicle; and the provision of such apparatus utilizing an infrared sensor to help the user locate the target in obscured battlefield environments and at night, and to track the missile's thermal beacon.

Briefly, the apparatus of the present invention is for acquiring, tracking, and guiding an object to a target. A thermal beacon is carried on the object and provides an infrared indication of its location. A tracking system scans a field of view which includes an image of the object as produced by the beacon as well as an image of the target, and converts the image from each scan into two separate electrical signals one of which is supplied as an output on a first signal channel and the other of which is supplied as an output on a second and separate signal channel. A first signal processor processes the electrical signal on the first signal channel and generates a signal for target acquisition and target tracking. A second signal processor processes the electrical signal on the second signal channel to determine the location of the object relative to the target. The second signal processor is also responsive to the presence of a plurality of visual images appearing in a scan of the field of view in which the target and object appear to differentiate between the image representing the object and the other images. This is done on the basis of a predetermined set of criteria. A missile controller is responsive to the location information to generate and transmit a control signal to the object to guide it to the target.

As a method, the invention includes providing an indication of the location of an object by a thermal beacon carried thereon. The object is acquired and tracked in response to an infrared indication of its location by scanning a field of view which includes an image of the object as produced by the beacon as well as the image of a target at which the object is directed. The image from each scan is converted into two separate electrical signals one of which is supplied as an output on a first signal channel and the other of which is supplied as an output on a second and separate electrical channel. The electrical signal on the first signal channel is processed to generate a display signal for producing a visual display of the field of view including the target and the object. The electrical signal on the second signal channel is processed to determine the location of the object relative to the target. Processing of the electrical signals includes responding to the presence of a plurality of visual objects appearing in any one scan by differentiating between the missiles beacon signature and other objects. This differentiation is based upon a predetermined set of criteria. A control signal is generated based upon its location information and transmitted to the object to guide it to the target.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
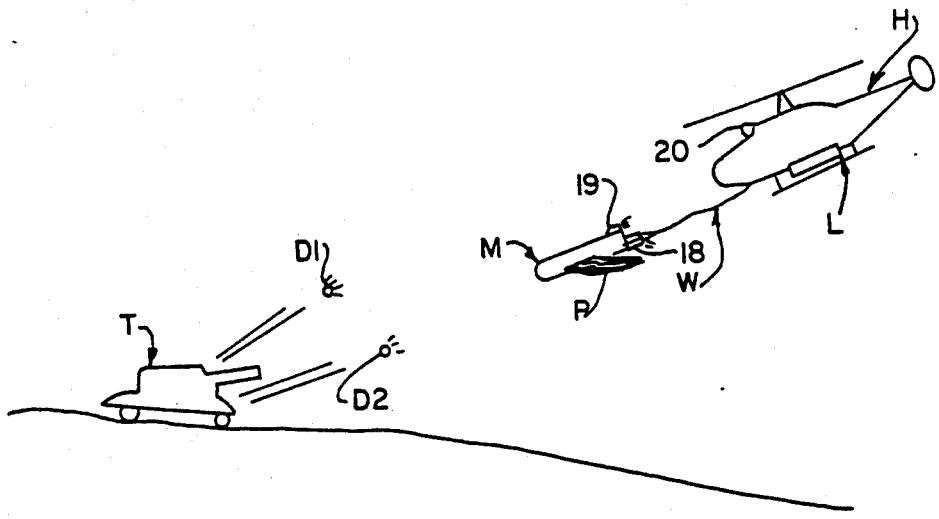
FIG. 1 is a representation of a battlefield environment in which a helicopter launched missile is directed at a target such as a tank.
Figure 2:
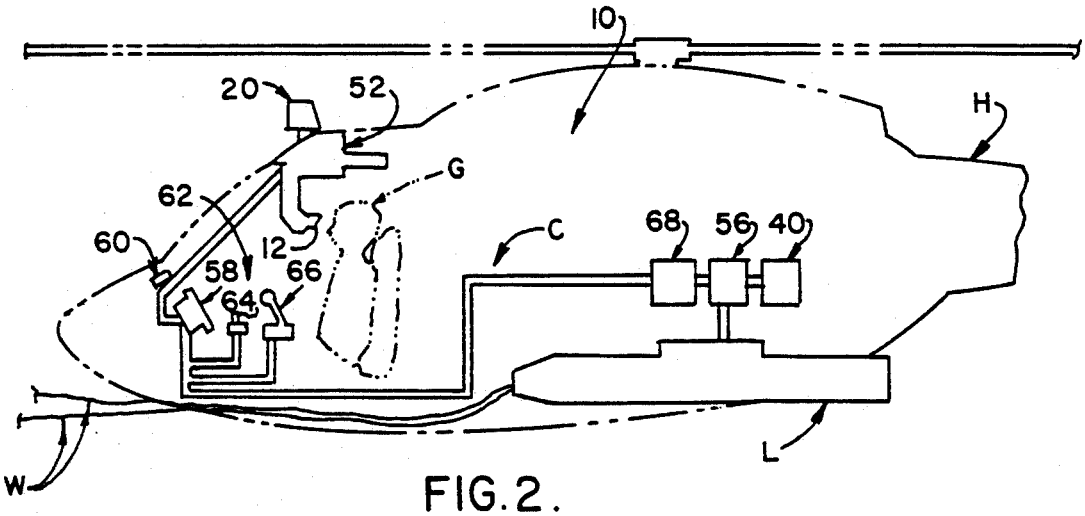
FIG. 2 is an outline view of the helicopter illustrating the location thereon of the various components comprising the apparatus of the present invention.

Referring to the drawings, apparatus of the present invention is indicated generally 10. The apparatus is used for acquiring tracking, and guiding an object such as a TOW missile M to a target T which is, for example, a tank. As shown in FIGS. 1 and 2, missile M is launched from a helicopter H. A gunner G seated in the helicopter utilizes a visual display 12 of the apparatus to locate the target. He then fires the missile from a launcher L which is mounted on the side of the helicopter. The missile has control wires W attached to it and these are used to guide the missile to the target as is described hereinafter. The gunner looks at the visual display (see FIGS. 2 and 4) as he constantly views the target. The display includes a reticle 14 (see FIG. 4) by which the gunner sights the target by maintaining crosshairs 16*a*, 16*b* of the reticle fixed on the target. It will be understood that target tracking may be accomplished automatically, as described hereinafter, by a target tracking unit 17 which processes the information on a video channel by which the gunner's display is produced.

Because the helicopter may be flying over a battlefield obscured by smoke and dust, or because it is night, the missile preferably carries an infrared beacon which can produce a visual indication of the missile in the field of view observed by the gunner. The missile includes both a xenon beacon 18 which radiates light in the near infrared portion of the spectrum and an infrared source 19 which radiates light in the far infrared portion of the spectrum. These units are activated at launch of the missile or shortly thereafter. To locate and track the missile beacons in the near and far regions of the light spectrum, the helicopter is equipped with a sight unit 20. This unit includes a xenon beacon detector, a forward looking infrared receiver or FLIR, and a gimbal for pointing and stabilizing both. When a missile M is launched, a plume P of exhaust from the missile's launch motors appears in the gunner's display. Because of the intensity of this light, tracking is initially done using xenon beacon 18. When the missile's fuel is spent, the plume disappears. Switchover of tracking may now be made from the xenon beacon to the infrared beacon. This is referred to as "hand-off" After "hand-off", the location of the missile in the field of view is based upon the track of beacon 19.

Figure 3:
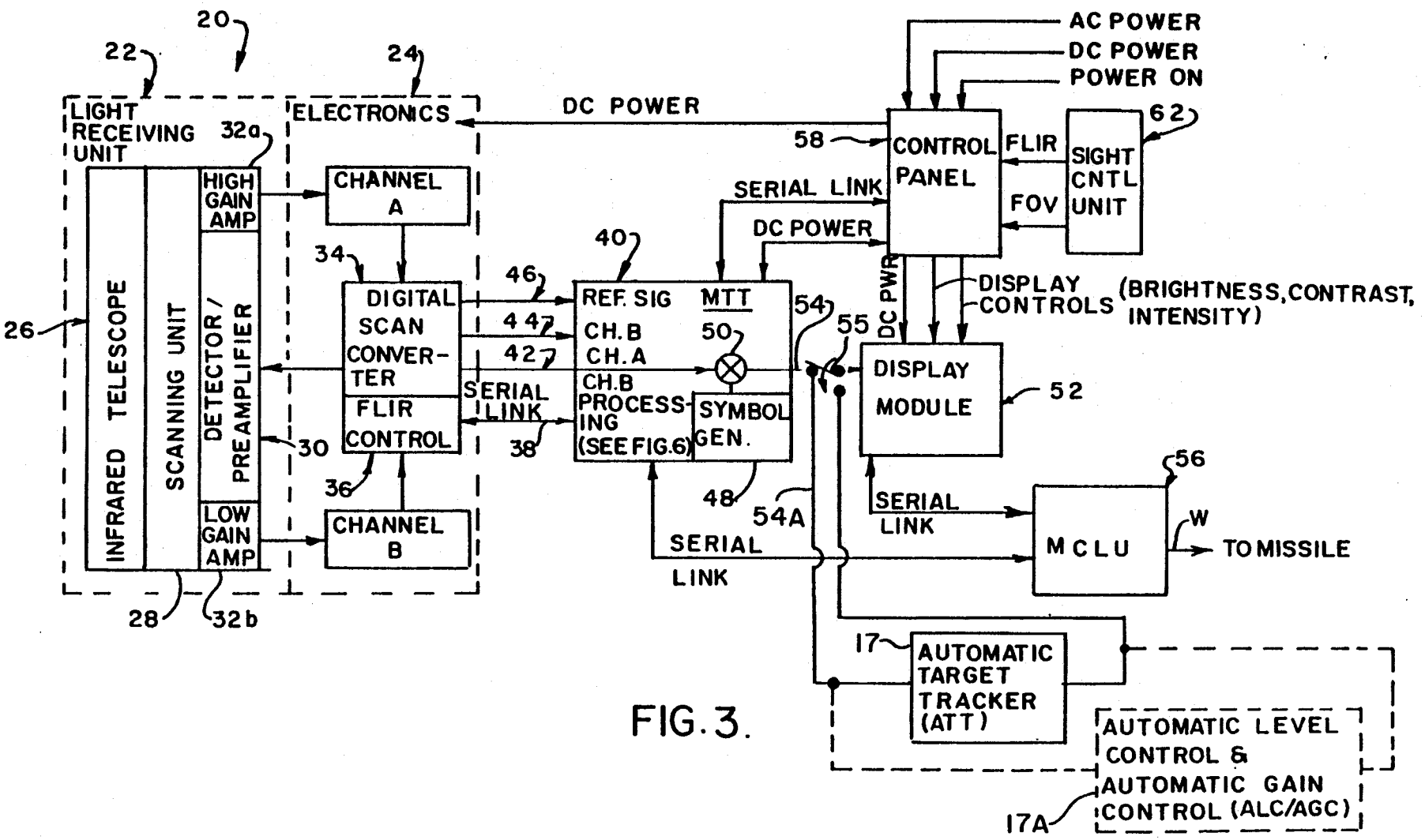
FIG. 3 is a block diagram of the apparatus.

The FLIR includes a light receiving unit 22 and an electronics unit 24 (see FIG. 3). Unit 22 includes an infrared telescope 26 and a scanning unit 28. The scanning unit continuously and repetitively scans the field of view for the FLIR to register infrared images emanating from the target, the beacon and other objects such as the countermeasure decoys D1 and D2 shown in FIG. 1. The decoys create alternate light sources in the field of view with the expectation the apparatus will mistakenly try to guide a decoy toward the target; and in so doing, guide the missile away from it. The apparatus functions to not only detect presence of these decoys in the field of view but also differentiates between them, the target, and the missile.

Operation of the FLIR is such that a detector unit 30 responds to the infrared light impinging on the telescope during each scan to generate an analog electrical signal representing the objects present in the field of view. Detector 30 includes a preamplifier section in which the analog electrical signal is amplified and converted to a digital signal having a plurality of signal elements. Each signal element, in effect, represents a pixel in the video frame of the field of view scanned by scanner 28. It is a feature of the present invention that the electrical signal is separated into two identical electrical signals within the detector unit, with each electrical signal thereafter being separately processed. One of the signals is supplied on a first signal channel which is hereafter referred to as channel A; while the other signal is supplied on a second signal channel hereafter referred to as channel B. The channel A signal is used to create a visual display of the field of view (including the target) and the channel B signal is used to determine location of the missile relative to the target so a control signal, if needed, can be generated and sent to the missile to guide it to the target.

For detecting and tracking purposes, the visual display must provide good resolution of both the target and background features. As a consequence, it is preferable for amplification of the electrical signal on channel A to be greater than that of the signal on channel B. The gain and level on channel A are controlled by the gunner, or automatically, for optimum detection, recognition, and tracking of the target. The gain and level on channel B are separately and automatically controlled for optimum tracking of the missile, and discrimination of the missile from target, clutter, and countermeasures. For this purpose, detector 30 has a high gain amplifier section 32*a* in which the signal for channel A is amplified; and, a low gain amplifier section 32*b* in which the channel B signal is amplified. After amplification, the signals on both channels are supplied from detector 30 to the electronics unit 24 portion of the FLIR.

The electronics unit includes both a digital scan converter 34 and FLIR control section 36. The channel B signal is supplied to the digital scan converter through the FLIR control section. The digital scan converter converts the digital signals on channels A and B back into analog signals. The FLIR control unit through which the channel B signal is routed is connected by a serial link 38 to a missile thermal tracker unit (MTT) 40. The MTT supplies control signals via the serial link to the FLIR control to change the gain and level of channel B so as to maximize the image of the missile while suppressing the images of the target and the background.

After the digital-to-analog conversion is completed, the signals on channels A and B, together with a reference signal, are supplied to the MTT on respective lines 42, 44, and 46. The missile tracker includes a symbol generator 48 which produces the reticle 14 for the visual display observed by the gunner. An electrical signal representing the reticle is supplied from symbol generator 48 and is multiplexed with the channel A signal as indicated at 50. The resultant signal is then provided to a display module 52 via a video signal path 54. Interposed between the output of the MTT and the display module is a switch 55. If the gunner is manually tracking the target, the switch is in its position shown in FIG. 3. If, however, the target is to be automatically tracked, the switched is moved to its other position. The channel A signal is then routed over a line 54A to the automatic target tracker (ATT) 17 referred to above. The ATT then performs the target tracking function and supplies the video to the display module. In some applications, an automatic level control (ALC-)/automatic gain control (AGC) unit 17A is used in place of the ATT to perform only a tracker control of channel A gain and level.

Figure 4:
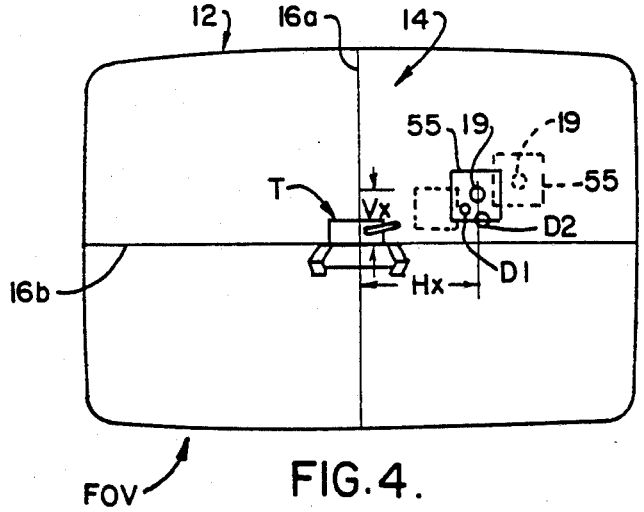
FIG. 4 represents a scan of the field of view including a "track gate" and illustrates the location of the missile relative to the target.

While the electrical signal on channel A is being processed for display purposes, the tracking signal on channel B is being processed by the MTT to determine the position of the missile relative to that of the target. As shown in FIG. 4, the MTT creates a track box 55 which represents the predicted location of the missile in the field of view. The MTT utilizes the missile information on channel B to change the location of the track box as the missile moves toward the target. In FIG. 4, missile 18 is displaced from the center of the crosshairs by a vertical distance Vx and horizontal distance Hx. The MTT is responsive to the sensed location of the missile relative to the target, and information from prior scans with respect to the speed and direction of the missile, to determine if the missile is on the proper course to impact the target. Missile position information is supplied from the MTT to a missile command and logic unit (MCLU) 56. The MCLU, in turn, responds to the MTT to generate a control signal which is supplied over lines W to the missile to correct its course, if a course correction is required, so the missile impacts the target.

In addition to the elements of the apparatus previously described, apparatus 10 further includes the following components. A control panel 58 (see FIG. 2) provides a primary system interface for the gunner. The control panel also displays the status of the apparatus, distributes primary aircraft power to the various components comprising the system, and generally allows the user to exercise control over the apparatus. A sight line indicator 60 provides the pilot of the helicopter with position data and the firing status of the launch system. This enables the pilot to maneuver the helicopter to a launch attitude which assures a successful missile launch and subsequent "capture" of the missile by the tracking system.

A sight control unit 62 includes a control stick 64 which allows the gunner to control the sight line for target tracking. The gunner also has available a hand control 66 which allows him to select which of a plurality of TOW missiles the helicopter is carrying to fire, and allows him to move between various operating modes of the apparatus. Finally, a sight electronics unit 68 contains electronics required for steering and stabilizing the line of sight. As shown in FIG. 2, a cable system C includes cables which are internally routed within the helicopter to interconnect the different components comprising the apparatus. While the system as described is shown installed in a helicopter, the system can also be installed in a ground vehicle.

In operation, when a missile is fired, a master timer 70 (see FIG. 6) within the MTT is started. This provides a temporal synchronization of all the various components comprising the apparatus. The MTT unit begins to scan the video signal produced by the FLIR while, at the same time, the xenon beacon detector scans the field of view to locate the xenon beacon on the missile. When the missile is located, the MTT generates the track gate 55 shown in FIG. 4. For this purpose, the channel B tracking signal on line 44 is directed through an analog-to-digital converter 71 to the input of a buffer 72. The bits B1-Bn of data comprising the digital data stream of the channel B signal $S_B$ are then supplied to an input of a threshold control unit 74. The data bits each represent a pixel element within the video scan of the field of view. The threshold control unit compares each bit against an upper and lower threshold level. These levels bound the expected image intensity for the beacon on the missile (which should be the brightest object in the field of view). Pixels with intensities which are above or below these threshold levels are taken to be background.

Figure 5A:
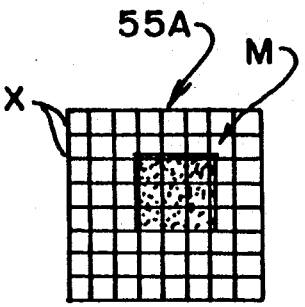
FIGS. 5A-5E illustrate the segmenting of multiple images appearing within the track gate to distinguish the missile from the other images.

Referring to FIG. 5*a*, the field of view (FOV) is shown broken down into the individual pixel elements X. The data bits comprising the channel B signal which are within the thresholds are shown as the darkened squares within the field of pixel elements. These darkened squares represent missile M.

The pixel information developed by the threshold control unit is supplied to a predictor unit 76 comprising modules 77A and 77B. Their function is to predict where the missile will appear in the next scan of the field of view. It does this based upon previous missile location information provided to it, as well as the current information supplied by the threshold control unit. Additionally, co-ordinate information of the missile's location is supplied to a track box generator 78 which generates the track box 55 shown in FIG. 4. The track box generator generates both the location for the track box in the next frame of scanning, and the size of the track box. This in response to inputs from the predictor unit 76. It will be appreciated that when the missile is first located, it will appear adjacent to one side of the field of view and gradually move to the reticle which the gunner is keeping on the target. Also, as the missile moves downrange, it becomes a smaller visual image. The location and size of the track box are changed accordingly as this occurs. This change is represented by the dashed line track boxes 55 shown in FIG. 4. Use of the track box is advantageous since it reduces the area in the field of view where the apparatus will be looking to find the missile to a relatively small area. This speeds up the tracking process and discriminates against countermeasures and clutter outside the track gate.

The track box location information developed by the track box generator is supplied through a buffer 80 both to the predictor unit and to an interface module 82. The pixel information from threshold control 74 is also supplied to the interface. The interface, in turn, is connected to MCLU 56. The operation of the channel B tracking signal processing is controlled by a microprocessor 84 which utilizes an algorithm. Inputs to and from the microprocessor are via a bus 86.

In the tracking sequence, the initial step is to search the entire field of view until the missile is located. As noted, a track box is then generated in which the missile should appear. If the target perceives the threat of the missile moving toward it, it may take countermeasures against the missile. As shown in FIG. 1, it may, for example launch decoys D1 and D2 which are thermal sources. This is done with the expectation the apparatus will mistake one of these thermal sources for the infrared beacon on the missile.

Figure 5B:
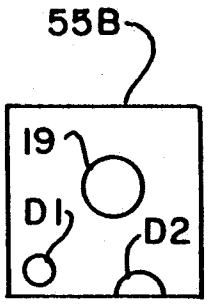

Referring to FIG. 5*b*, a track gate 55A is shown in which the infrared beacon !9 on the missile is shown generally centered within the track gate. It will be understood that while the beacon would appear as a point source of light to someone looking through the visual display, in actuality, the image is comprised of a number of pixels. Also shown within the track are thermal images generated by the decoys D1 and D2. These decoys will also appear as point sources of light in the display; but again, each is comprised of a number of pixels.

When countermeasures are encountered, or other blobs of light appear within the track gate, the MTT acts to differentiate between the image representing the beacon on the missile and the other images. It goes through a segmentation procedure in which each blob of light is analyzed. This analysis is based upon criteria which define the characteristics the beacon image has at the time the blobs appear. Thus, the MTT first determines the location of each blob within the track gate. Since the track gate frames the beacon image, it should be generally centered within the track gate. The MTT therefore analyzes the cluster of pixels representing each blob, determines their centroid and compares that against the location of the center of the track gate. The image whose centroid either approximates or is closest to the center of the track gate is presumably the beacon and hence the missile. Also, since the beacon image is centered within the track gate, the MTT will determine if any blob is touching a side of the track gate. If one does, for example, the blob D2 in FIG. 5*b*, it is identified as not being the beacon or missile.

Figure 5C:
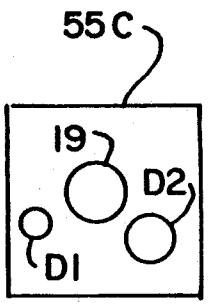

In addition to the parameters discussed above, the MTT also determines the number of pixels comprising each blob and compares that value to the number of pixels which the image of the beacon should include. This value is a function, for example, of the time since missile launch and hence its distance downrange from the helicopter. The predictor unit within the MTT has stored within it the expected relative size of the beacon at various points along its trajectory. The predictor unit uses this stored information, plus the actual observed size appearing during the preceding moments of flight, to predict the size of the beacon image for the next scan. If the number of pixels required to form a blob is greater or less than the given value, the MTT can differentiate it from the beacon image. Thus as shown in FIG. 5*c*, both blobs representing decoys D1 and D2 appear smaller than the beacon image and would be identified by the MTT as other than the beacon or missile.

While it cannot be readily shown in the drawings, the MTT also analyzes the intensity of each image and compares that information with a value representing the image intensity for the beacon. If the intensity level of a blob does not correspond to that for the beacon at that time, it can be identified as other than the beacon or missile.

Figure 5D:
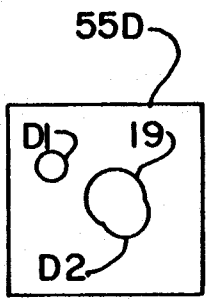
Figure 5E:
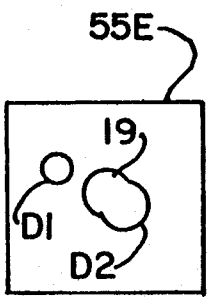

It will be appreciated that the segmentation of blobs into the image of the beacon and images of decoys, jamming devices, or other extraneous radiation sources is not based upon any of the above criteria alone. Rather, this portion of the MTT includes an algorithm in which all of the aforementioned factors are considered together in differentiating one blob from another and determining which blob is the beacon and which is not. Further, the MTT, once a blob has been identified, keeps track of the blob in addition to the beacon; thus, even if the track of a blob intersects that of the missile, as shown in FIGS. 5*d* and 5*e*.

What has been described is a TOW missile tracking and guidance system utilizing two independent channels. One channel is used for generating visual images used to depict a field of view observable by a gunner, and particularly objects including the target and missile appearing in the field of view. The system further is capable of quickly and effectively distinguishing the missile (or the beacon carried on the missile) from other objects appearing in the field of view using segmentation techniques based upon the size, location, and image intensity of each of the objects within a defined portion of each frame of scanning.

Figure 7:
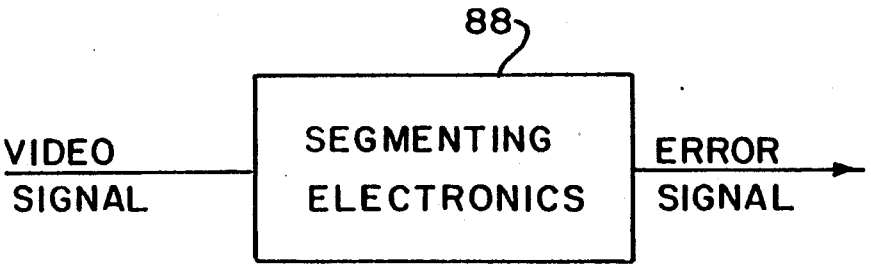
Figure 6:
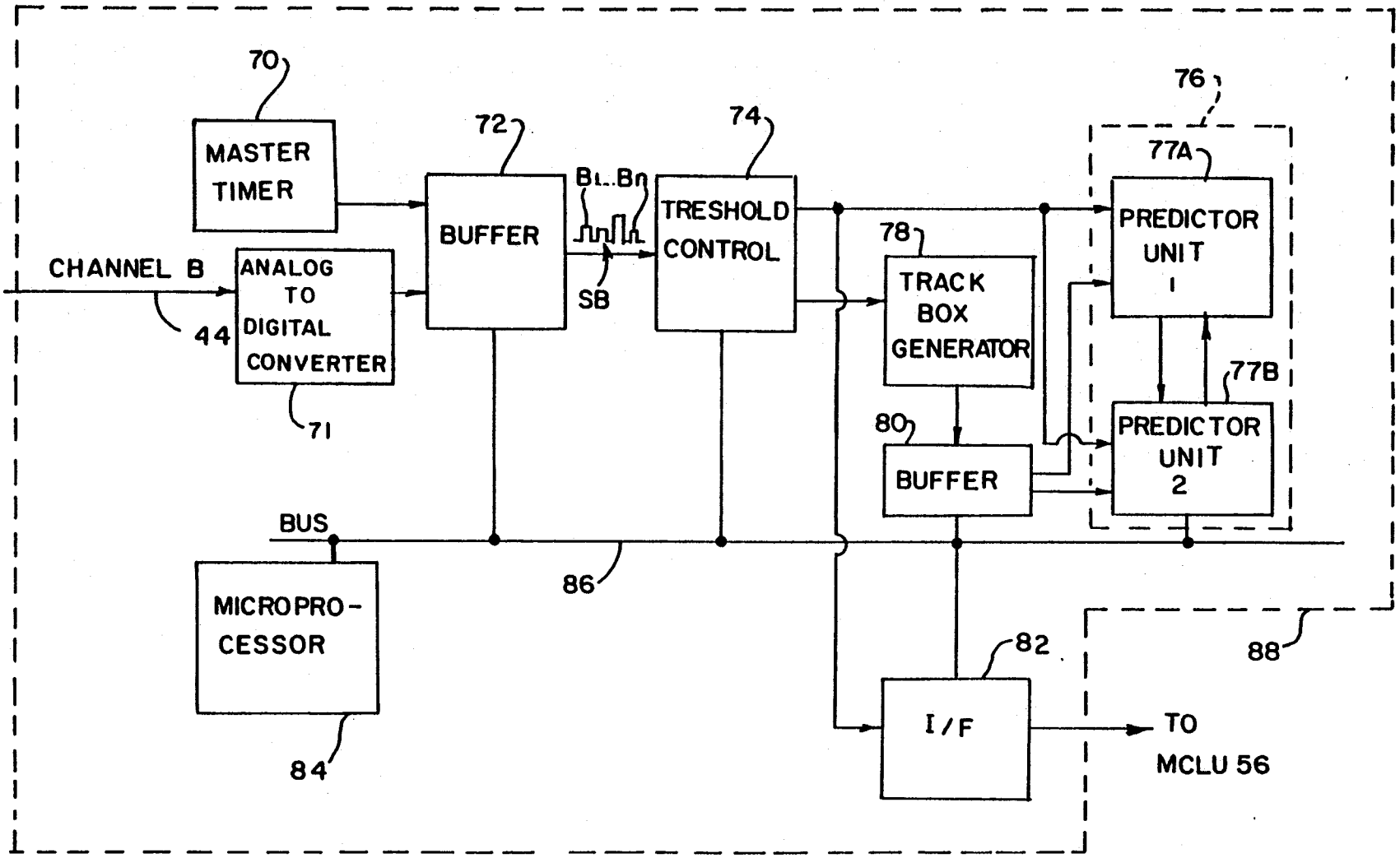
FIG. 6 is a block diagram of a tracking signal processing portion of the apparatus; and, FIG. 7 is a block diagram illustrating usage of a segmentation tracker of the present invention with other signal sources to produce an error signal.

It will be understood that the segmentation process is accomplished by those components in the module indicated generally 88 in FIG. 6. As shown in FIG. 7, module 88 can be used with a variety of signal sources such as a video signal source to process the signal and develop an error signal which is supplied to a using system or module (not shown). The segmentation process described above is accomplished in the same manner; although, the algorithm employed may vary depending upon the particular application. In view of the above, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

We claim:

1. Apparatus for acquiring, tracking and guiding an object to a target comprising:

beacon means carried on the object for providing an indication of its location at any time during its movement toward the target;

acquisition means responsive to the beacon means for acquiring and tracking the object, the acquisition means including means for scanning a field of view which includes an image of the object as produced by the beacon means, and means for converting the image from each scan into two separate electrical signals one of which is supplied as an output non a first signal channel and the other of which is supplied as an output on a second and separate signal channel;

first processing means for processing the electrical signal on the first signal channel to generate a display signal for producing a visual display of the field of view including the target and the object, and display means to which the display signal is supplied for producing the visual display;

second processing means for separately processing the electrical signal on the second signal channel to determine the location of the object relative to the target; and, control means responsive to the location for generating and transmitting a control signal to the object to guide it to the target.

2. The apparatus of claim 1 wherein the conversion means includes detector means for detecting images appearing in the field of view during each scan and producing first and second electrical signals representative thereof.

3. The apparatus of claim 2 wherein the scanning means further includes amplifier means for amplifying the first and second electrical signals, the amplifier means amplifying the first electrical signal at a first gain and level and supplying the resultant amplified signal to the first signal channel, and amplifying the second electrical signal at a second gain and level and supplying the resultant amplified signal to the second signal channel.

4. The apparatus of claim 3 further including symbol generating means for generating a reticle for presentation on the display means and means for combining an electrical signal representing the reticle with the first electrical signal on the first signal channel.

5. The apparatus of claim 3 wherein the second processing means includes means for determining the position of the object in the field of view relative to the location of the target therein and for supplying a position signal to the control means representing any difference therebetween.

6. The apparatus of claim 5 wherein the position determining means includes means for establishing signal threshold levels representative of the intensity of the image of the object in the field of view and for comparing the elements of the electrical signal on the second channel against the threshold to determine where in the field of view the object is located.

7. The apparatus of claim 6 wherein the second processing means further includes means defining a spatial window in the field of view in which the image of the object should appear and means for changing the size of the window and its location in the field of view as the object approaches the target.

8. The apparatus of claim 1 wherein the beacon means comprises an infrared beacon for providing a thermal indication of the location of the object and the acquisition means includes an infrared receiver.

9. A method for acquiring, tracking and guiding an object to a target comprising:

providing an indication of the location of the object by a beacon means carried thereon;

acquiring and tracking the object in response to the indication by scanning a field of view which includes an image of the target and the object as produced by the beacon means, and converting the image into two corresponding electrical signals one of which is supplied as an output on a first signal channel and the other of which is supplied as an output on a second and separate electrical channel;

processing the electrical signal on the first signal channel and generating a display signal for producing a visual display of the field of view including the target and the object;

displaying the field of view on a display means in response to the display signal;

processing the electrical signal on the second signal channel to determine the location of the object relative to the target; and, generating and transmitting a control signal to the object to guide it to the target.

10. Apparatus for acquiring, tracking and guiding an object to a target comprising:

beacon means carried on the object for providing an indication of the location of the object at any time during its movement toward the target;

acquisition means responsive to the beacon means for acquiring and tracking the object as it moves toward the target, the acquisition means including means for repetitively scanning a field of view which includes an image of the object as represented by the signature thereof, and means for converting the image from each scan to an electrical signal;

means for processing the sequence of electrical signals to determine the location of the object relative to the target in the presence of other objects appearing in any one scan to differentiate between the object's signature and the other objects based upon a predetermined set of criteria the processing means including means for differentiating between multiple objects based upon the intensity of the respective objects, their geometric shape, their centroids, and the number of pixels they include; and, control means responsive to the location of the object relative to the target for generating and transmitting a control signal to the object to guide it to the target.

11. The apparatus of claim 10 wherein the processing means includes means defining a spatial window for each scan in which the image of the object should appear and the processing means further includes means for differentiating between multiple images based upon whether or not an object is touching a side of the window.

12. The apparatus of claim 11 wherein the processing means includes means for establishing threshold levels representative of the intensity the image of the object should have, and means for comparing the signal level of elements comprising the signal against the threshold to determine where in the window the object appears and if other objects also appear within the window.

13. The apparatus of claim 12 wherein the processing means includes means for predicting where in succeeding scans the image representing the object should appear and for moving the window in accordance with the prediction thereby for the image representing the object to appear in the window in each scan.

14. The apparatus of claim 13 wherein the beacon means comprises an infrared beacon and the image produced thereby is a thermal image.

15. A method of acquiring, tracking and guiding an object to a target comprising:

providing an indication of the location of the object by a beacon means carried thereon;

acquiring and tracking the object in response to the indication, tracking of the object including repetitively scanning a field of view which includes an image of the target and the object as represented by the indication thereof, converting the image from each scan into an electrical signal;

processing the sequence of electrical signals to determine the location of the object relative to the target in each successive scan, signal processing including responding to the presence of a plurality of objects appearing in any one scan by differentiating between the signature representing the object and the other objects based upon a predetermined set of criteria, this differentiating including comparing the intensity of the respective signature for these objects, their geometric shape, and the number of pixels each includes, and determining the centroids of each image and whether or not an object touches the sides of a track window; and, generating and transmitting a control signal to the object in response to its location relative to the target to guide it to the target.

16. The method of claim 15 wherein processing of the electrical signal includes defining a spatial track window in the field of view in which the image of the object is expected to appear and moving the window from one scan to the next as the object approaches the target.

17. The method of claim 16 wherein processing the electrical signal further includes establishing threshold levels representative of the intensity the image of the object should have, and comparing the signal level of elements comprising the signal against the threshold to determine the location of the object in the window; and, if other objects also appear within the window, the appearance of a plurality of objects in the window requiring the differentiation therebetween.

18. A method of acquiring, tracking and guiding an object to a target comprising:

providing a thermal indication of the location of the object by an infrared beacon means carried thereon;

acquiring and tracking the object in response to the thermal indication, tracking of the object including repetitively scanning a field of view which includes images of the target and the object as represented by the thermal indications thereof, converting the images from each scan into an electrical signal; and, processing the sequence of electrical signals to determine the location of the object relative to the target in each successive scan, the signal processing including defining a spatial window in the field of view in which the image of the object is expected to appear and moving the window from one scan to the next, and responding to the presence of a plurality of objects appearing in the window by segmenting the signature representing the beacon from the other objects by determining and comparing the intensity of the respective objects, their geometric shapes, the number of pixels comprising each object, the centroids of each object and whether or not an object touches the sides of the window.

19. Apparatus for processing an electrical signal comprising:

means for predicting the value of a parameter which the signal represents based upon information acquired from the processing of prior electrical signals, for determining the actual value of the parameter from the current electrical signal, and for comparing the actual value with the predicted value;

means controlling operation of the aforesaid means and utilizing an algorithm to perform the value prediction, value determination, and value comparisons, the controlling means being responsive to signal elements of the electrical signal which may distort the actual value of the parameter to distinguish between these elements and those elements of the signal from which the actual value is derived to segment and characterize the various signal elements so the actual value is not distorted; and, means for generating an error signal whose characteristics are a function of the difference between the actual and predicted values, the error signal being supplied as an output of the apparatus to a using system which utilizes the error signal to effect a change by which the actual value derived from a subsequent electrical signal will equal a subsequent predicted value.

20. The apparatus of claim 19 further including means defining a "window" within which the predicted value occurs, the actual value also supposedly falling within the window, and the range of values which the window covers changing over time to reflect changes in the actual and predicted values over time.

21. The apparatus of claim 20 further including threshold means for determining if the signal level of a signal element meets a predetermined threshold requirement.

22. The apparatus of claim 21 wherein the apparatus processes only digital signals and further includes an analog-to-digital converter to convert analog signals to digital signals.

23. The apparatus of claim 22 further including timing means to provide temporal synchronization of the apparatus.

24. The apparatus of claim 19 for processing video signals.

25. The method of processing an electrical signal comprising:

predicting the value of a parameter which the signal represents based upon information acquired from the processing of prior electrical signals;

determining the actual value of the parameter from the current electrical signal;

comparing the actual value with the predicted value;

generating an error signal whose characteristics are a function of the difference between the actual and predicted values; and, controlling the performance of the aforesaid steps utilizing an algorithm, control of the aforesaid steps including recognizing when signal elements of the electrical signal may distort the actual value of the parameter and segmenting these elements from those elements of the signal from which the actual value is derived so the actual value is not distorted, segmenting of the signal elements including determining the relative intensity thereof, and the relative size, shape and location of the information represented thereby.

26. The method of claim 25 further including supplying the error signal to a using system which utilizes the error signal to effect a change by which the actual value derived from a subsequent electrical signal will equal a subsequent predicted value.

27. The method of claim 26 further including determining if the signal level of a signal element meets a predetermined threshold requirement.

28. The method of claim 27 further including converting an analog signal to a digital signal prior to processing of the signal.

29. The method of claim 25 for processing video signals.

* * * * *

UNITED STATES PATENT AND TRADEMARK OFFICE

CERTIFICATE OF CORRECTION

PATENT NO. : 5,062,586

DATED : November 5, 1991

INVENTOR(S) : Gregory L. Hobson et al

It is certified that error appears in the above—identified patent and that said Letters Patent is hereby corrected as shown below:

Claim 1 Col. 10 Line 23 is "non" should be --on--.

Signed and Sealed this

Ninth Day of March, 1993

*Attest:*

STEPHEN G. KUNIN

*Attesting Officer*

*Acting Commissioner of Patents and Trademarks*